US006142616A

United States Patent [19]

Akahane

[11] Patent Number: 6,142,616

[45] Date of Patent: Nov. 7, 2000

[54] INK JET RECORDING HEAD

[75] Inventor: Fujio Akahane, Nagano, Japan

[73] Assignee: Seiko Epson Corporation, Tokyo, Japan

[21] Appl. No.: 09/048,788

[22] Filed: Mar. 27, 1998

[30] Foreign Application Priority Data

Mar. 27, 1997 [JP] Japan ..... 9-076253

[51] Int. Cl.[7] ..... B41J 2/045

[52] U.S. Cl. ..... 347/71

[58] Field of Search ..... 347/68, 69, 70, 347/71; 29/890.1

[56] References Cited

U.S. PATENT DOCUMENTS

| | | | |
|---|---|---|---|
| 4,730,197 | 3/1988 | Raman et al. | 347/40 |
| 4,835,554 | 5/1989 | Hoisington et al. | 347/94 |
| 5,605,659 | 2/1997 | Moynihan et al. . | |
| 5,670,999 | 9/1997 | Takeuchi et al. | 347/70 |
| 5,754,205 | 5/1998 | Miyata et al. | 347/70 |
| 5,852,456 | 12/1998 | Okada et al. | 347/71 |
| 5,856,837 | 1/1999 | Kitahara et al. | 347/70 |
| 5,896,150 | 4/1999 | Kobayashi et al. | 347/71 |
| 5,956,059 | 9/1999 | Usui | 347/71 |

FOREIGN PATENT DOCUMENTS

| | | |
|---|---|---|
| 0 490 668 A2 | 6/1992 | European Pat. Off. . |
| 0 606 767 A1 | 7/1994 | European Pat. Off. . |
| 0 611 154 A2 | 8/1994 | European Pat. Off. . |
| 0 616 890 A1 | 9/1994 | European Pat. Off. . |
| 0 759 362 A2 | 2/1997 | European Pat. Off. . |
| 0 761 447 A2 | 3/1997 | European Pat. Off. . |
| 5-504740 | 7/1993 | Japan . |

OTHER PUBLICATIONS

*Patent Abstracts of Japan*, vol. 015, No. 489 (M–1189), Dec. 11 1991 & JP 03 211 058 A (Fuji Electric Co. Ltd), Sep. 13, 1991.

*Primary Examiner*—Robert Beatty

*Attorney, Agent, or Firm*—Sughrue, Mion, Zinn, Macpeak & Seas, PLLC

[57] ABSTRACT

A silicon monocrystalline substrate (10) is provided with a piezoelectric element formed by a thin film process, and a plurality of pressure generating chambers 12 is arranged in high density by anisotropic etching. A narrow part (13) and a communicating part (14) are sealed by a sealing plate (20) which has a coefficient of linear expansion which does not exceed twice that of the silicon monocrystalline substrate. A common ink chamber (31) is provided with the sealing plate (20) as one surface and a thin wall (41) forms at least a part of the surface which is opposite to the sealing plate.

19 Claims, 9 Drawing Sheets

INK JET RECORDING HEAD

BACKGROUND OF THE INVENTION

1. Field of the Invention

The present invention relates to the structure of an ink jet recording head for jetting an ink droplet from a nozzle aperture by expanding or contracting a part of a pressure generating chamber communicating with a nozzle aperture by an actuator for flexural oscillation.

2. Related Art

The above ink jet recording head is classified into two types of a piezoelectric vibrator type for mechanically deforming a pressure generating chamber and pressurizing ink and a bubble jet type for providing a heating element in a pressure generating chamber and pressurizing ink by the pressure of bubbles generated by the heat of the heating element. The piezoelectric vibrator type of recording head is further classified into two types of a first recording head using a piezoelectric vibrator displaced axially and a second recording head using a piezoelectric vibrator for flexural displacement.

Although the first recording head enables high speed driving and recording in high density, it has a problem that the number of manufacturing processes is many because cutting is required for working its piezoelectric vibrator and three-dimensional assembly is required when a piezoelectric vibrator is fixed to a pressure generating chamber. In the meantime, although the second recording head is characterized in that a piezoelectric vibrator can be integrated with an elastic film constituting a pressure generating chamber by baking because the piezoelectric vibrator is filmy and the manufacturing process can be simplified, it has a problem that the width of the pressure generating chamber is increased and the density of an array is deteriorated because large area enough to enable flexural oscillation is required.

To solve such problems which the recording heads utilizing flexural oscillation have, an ink jet recording head provided with a passage formed substrate in which a pressure generating chamber, an ink supply port and a common ink chamber are formed by anisotropically etching a silicon monocrystalline substrate with a lattice plane (110) and a nozzle plate in which plural nozzle apertures communicating with a pressure generating chamber are formed wherein the other face of the passage formed substrate is constituted as a membrane which can be elastically deformed by a silicon oxide is proposed in Japanese published patent application No. H5-504740 for example.

According to the above ink jet recording head, as a driving part is formed by forming a piezoelectric material film in the area opposite to a pressure generating chamber of a membrane by a film forming method and the recording head can be constituted by etching and forming a film, the multiple recording heads with high printing density can be uniformly and simultaneously manufactured.

However, there are problems with the above structure in which a film to be a piezoelectric vibrator is formed using a silicon monocrystalline substrate to be improved to further enhance the quality of printing and to reduce the manufacturing cost.

As for a first problem, as a silicon monocrystalline substrate is thin and fragile, some reinforcement against impact and vibration is required.

As for a second problem, the coefficient of linear expansion of a silicon monocrystalline substrate is approximately $3\times10^{-6}/°$ C. and very small, compared with the coefficient of linear expansion of general metal and resin. Therefore, if metal and resin respectively with the large coefficient of linear expansion are used for the other head component when a silicon monocrystalline substrate is assembled by sticking an ink passage component and the other head component such as a nozzle plate together, tensile stress or compressive stress is applied to the silicon monocrystalline substrate due to a difference in the quantity of expansion or contraction between both as temperature changes. Stress applied to the silicon monocrystalline substrate particularly sensitively has an effect upon a thin film part and substantially changes the rigidity of an elastic film, therefore, pressure applied to a pressure generating chamber by a piezoelectric element and the vibrational characteristic of the pressure generating chamber are changed and as a result, the jetting of an ink droplet is unstable. The bonded body is warped due to the difference in expansion or contraction between the above-noted substrate and other componet and the failure of bonding is caused when a recording head is built in a frame and others in a succeeding process.

Next, a third problem will be described. A substrate in regular size (hereinafter called a wafer) normally such as four and eight inches is used for the silicon monocrystalline substrate. No matter how many pressure generating chambers and piezoelectric elements of recording heads are formed by one wafer, man-hours, time and material are unchanged. In addition, the manufacturing cost of a pressure generating chamber and a piezoelectric element accounts for most of the cost of a recording head. That is, the greater the number is of recording heads manufactured of one particular wafer, the lower the cost of one recording head can be. It remarkably reduces the number of recording heads manufactured of one wafer that a passage except a pressure generating chamber, particularly a common ink chamber requiring much area is formed in a silicon monocrystalline substrate as in the above prior example and as a result, the cost of a recording head is increased.

SUMMARY OF THE INVENTION

The present invention is made to solve these problems and the object is to provide a low-priced and reliable recording head in which an ink droplet can be stably jetted and high density and high quality of printing is enabled.

An ink jet recording head according to the present invention includes plural pressure generating chambers formed in the shape of a long window by anisotropically etching a silicon monocrystalline substrate for jetting an ink droplet from a nozzle aperture, an elastic film for coating one surface of the above silicon monocrystalline substrate and a piezoelectric element in which an electrode film, a piezoelectric material film and an electrode film are laminated in order corresponding to each pressure generating chamber on the surface reverse to the silicon monocrystalline substrate of the above elastic film, and characterized in that a narrow part and a communicating part are formed at the end far from a nozzle aperture of the pressure generating chamber of the above silicon monocrystalline substrate, the other surface of the silicon monocrystalline substrate is sealed by a sealing plate provided with an ink supply communicating port for connecting the above communicating part and a common ink chamber and the common ink chamber is adjacent to the silicon monocrystalline substrate via the sealing plate.

According to the present invention, at least the sealing plate is constituted by material having a coefficient of linear expansion which does not exceed twice the coefficient of linear expansion of the above silicon monocrystalline substrate.

According to the present invention, the ink jet recording head includes glass ceramics the coefficient of linear expansion of which is 2.5 to $4.5\times10^{-6}$/° C. are used for a sealing plate.

According to the present invention, the ink jet recording head includes a common ink chamber which is formed in a common ink chamber forming plate. The forming plate and a sealing plate are formed by glass ceramics having a coefficient of linear expansion of 2.5 to $4.5\times10^{-6}$/° C. The common ink chamber forming plate and the sealing plate are integrated by being either molded and baked after lamination or laminated and baked after molding.

According to the present invention, the ink jet recording head includes an alloy of iron and nickel the coefficient of linear expansion of which is 2.5 to $4.5\times10^{-6}$/° C. and which is used for at least a sealing plate.

According to the present invention, the ink jet recording head includes a common ink chamber which is provided with a thin wall at least in a part of the surface opposite to a sealing plate.

DETAILED DESCRIPTION OF THE PREFERRED EMBODIMENTS

Referring to drawings, embodiments of the present invention will be described below.

First Embodiment

Figure 1:
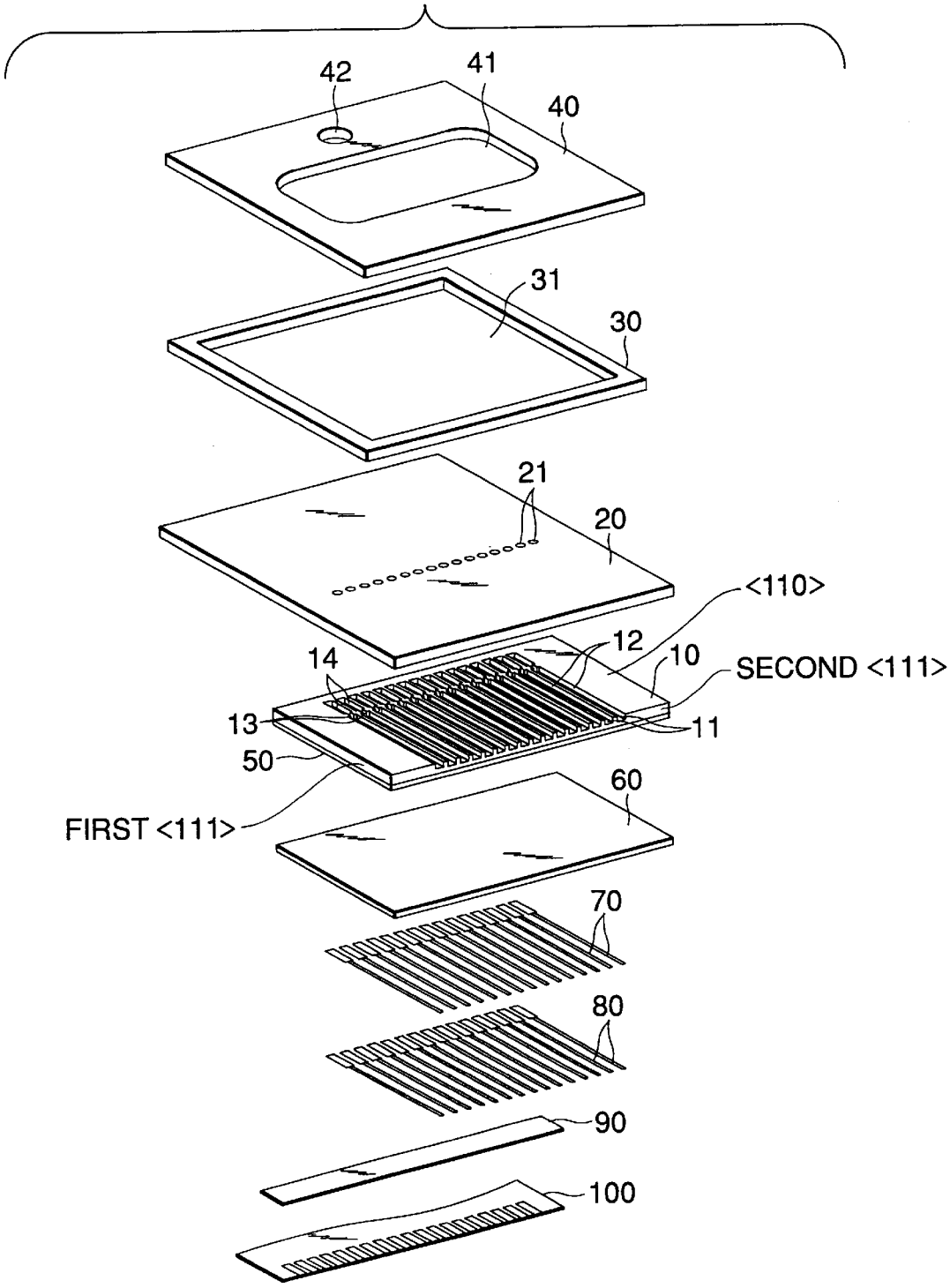
FIG. 1 is an exploded perspective drawing showing a first embodiment of the present invention.
Figure 2:
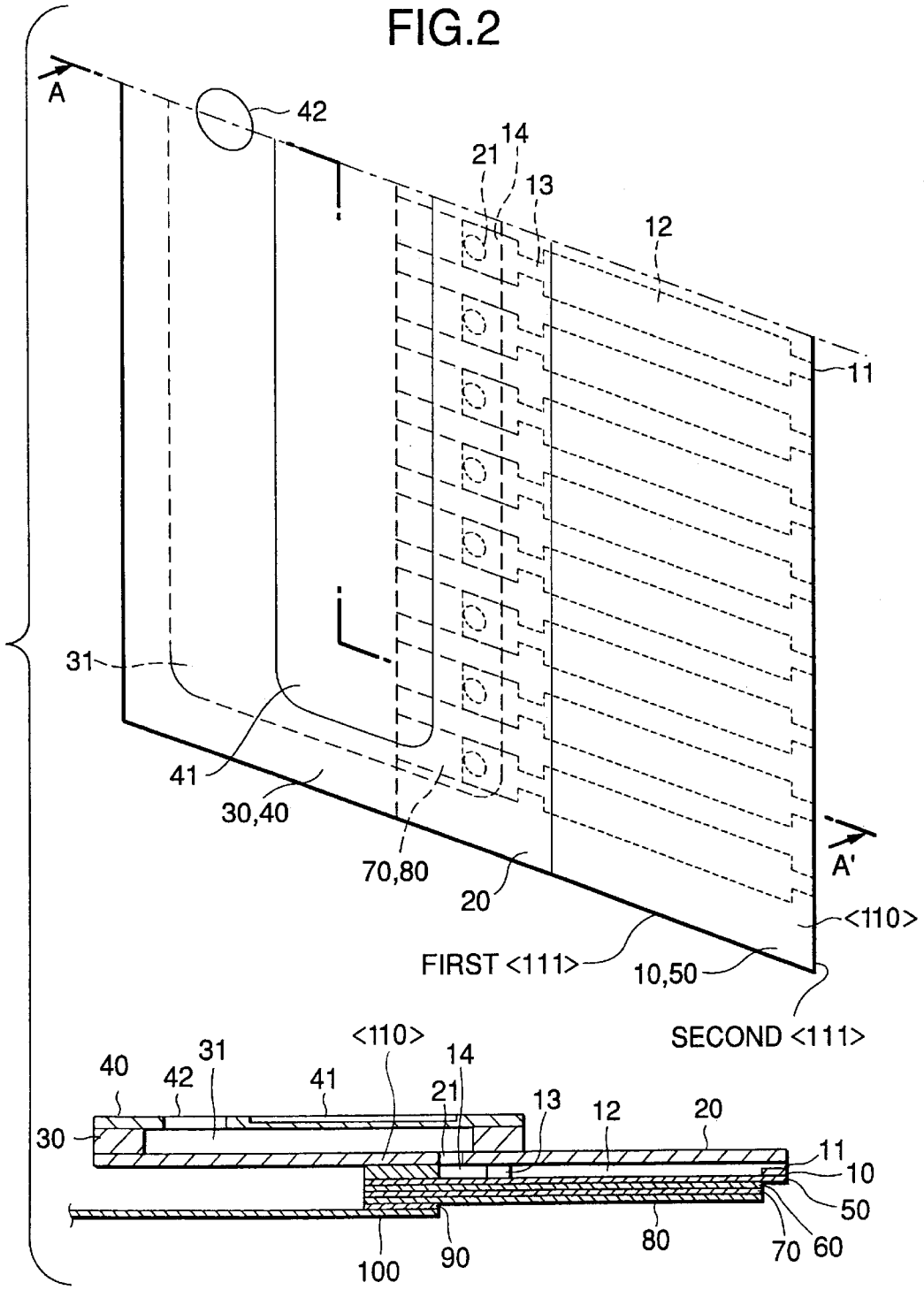
FIG. 2 is a plan and a sectional view respectively showing the first embodiment of the present invention.

FIG. 1 is an exploded perspective drawing showing a first embodiment of an ink jet recording head according to the present invention and FIG. 2 is a plan of FIG. 1 and a sectional view viewed along a line A–A' in FIG. 2. As shown in FIGS. 1 and 2, a reference number 10 denotes a silicon monocrystalline substrate with a lattice plane <110>. A silicon monocrystalline substrate 10 approximately 150 to 300 μm thick is normally used, a silicon monocrystalline substrate approximately 180 to 280 μm thick is desirable and preferably, a silicon monocrystalline substrate approximately 220 μm thick is suitable. It is because these allow high array density, keeping the rigidity of a partition between adjacent pressure generating chambers. A reference number 50 denotes an elastic film 1 to 2 μm thick composed of silicon dioxide formed beforehand by thermally oxidizing the surface of the silicon monocrystalline substrate 10. A lower electrode film 60 approximately 0.5 μm thick, a piezoelectric material film 70 approximately 1 μm thick and an upper electrode film 80 approximately 0.1 μm thick are laminated on the elastic film 50 in a process described later and constitutes a piezoelectric element. In this embodiment, the lower electrode film 60 functions as a common electrode for piezoelectric elements and the upper electrode 80 functions as an individual electrode of the piezoelectric element, however, they may be arranged contrarily for convenience of a driving circuit and wiring. A pressure generating chamber 12, a narrow part 13, a communicating part 14 and a nozzle aperture 11 are formed in the silicon monocrystalline substrate 10 by anisotropic etching described below.

In anisotropic etching, when the silicon monocrystalline substrate is dipped in alkaline solution such KOH, it is gradually eroded and a first plane (111) perpendicular to a plane (110) and a second plane (111) at an angle of approximately 70° with the first plane (111) and perpendicular to the plane (110) are formed. It is known that the etching rate of the plane (111) is approximately 1/180 of the etching rate of the plane (110). Precise working based upon working in the depth of a parallelogram formed by the two planes (111) is executed utilizing the above property. When the above technique is used for the ink jet recording head, the pressure generating chambers 12 can be arrayed in high density. In the present invention, the longer side of the pressure generating chamber 12 is formed by the first plane (111) and the shorter side is formed by the second plane (111).

The pressure generating chamber 12, the narrow part 13 and the communicating part 14 are etched up to the elastic film 50 through the silicon monocrystalline substrate 10. The above etching is collectively executed in the same process. As silicon dioxide forming the elastic film 50 is not dipped in alkaline solution for etching the silicon monocrystalline substrate 10, only the single crystal of silicon is removed. In the meantime, the nozzle aperture 11 is formed by etching the silicon monocrystalline substrate 10 halfway in the depth (half etching). Half etching is often used as a technique because the depth of working can be easily controlled by adjusting the time of etching.

The size of the pressure generating chamber 12 for applying ink droplet jetting pressure to ink, the size of the nozzle aperture 11 for jetting an ink droplet and the size of the narrow part 13 for controlling the inflow or outflow of ink into/out of the pressure generating chamber 12 are optimized according to the quantity of an ink droplet to be jetted, jetting speed and a jetting frequency.

For example, if 360 pieces of ink droplets per inch are jetted, the nozzle aperture 11 and the narrow part 13 are required to be precisely formed at the groove width of a few tens μm, however, they can be easily worked by the above anisotropic etching without a problem.

The communicating part 14 is a junction chamber for connecting a common ink chamber 31 described later and the pressure generating chamber 12 via the narrow part 13, an ink supply communicating port 21 of a sealing plate 20 described later corresponds to the communicating part 14 to distribute ink.

Figure 3:
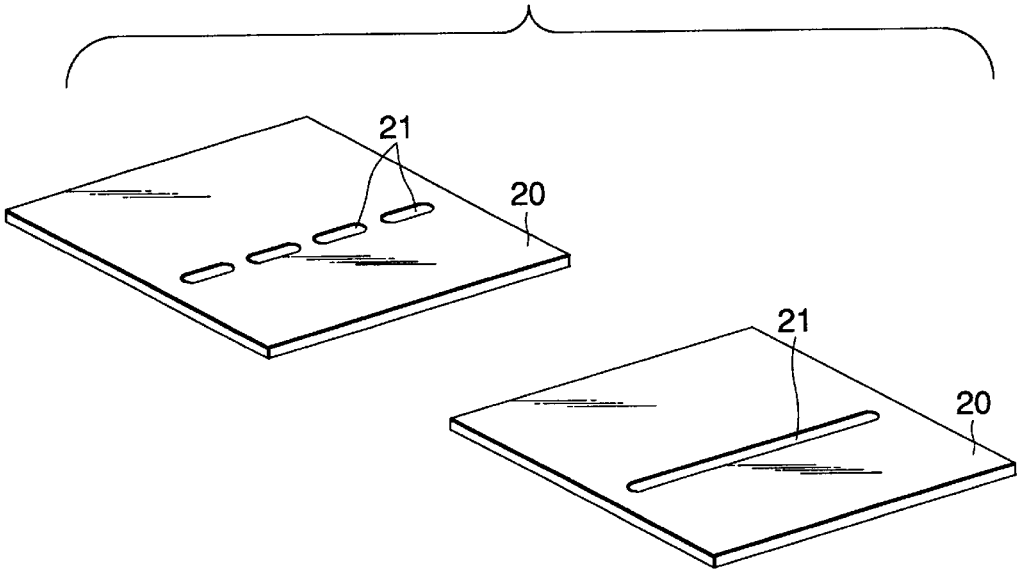
FIG. 3 is a perspective drawing showing a transformed part of a part constituting the first embodiment of the present invention.
Figure 4A:
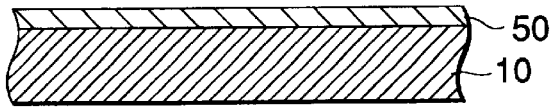
FIGS. 4(*a*)–(*f*) show a thin film manufacturing process in the first embodiment of the present invention.
Figure 4B:
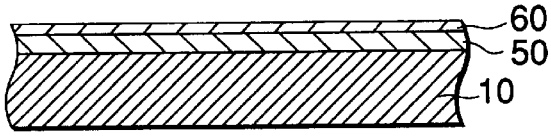
Figure 4C:
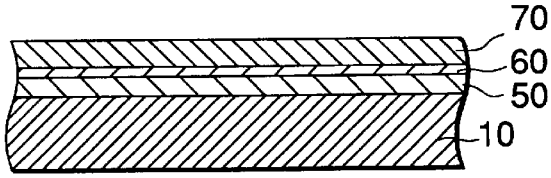
Figure 4D:
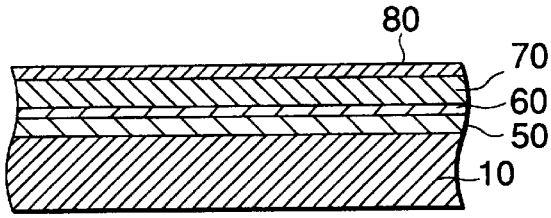
Figure 4E:
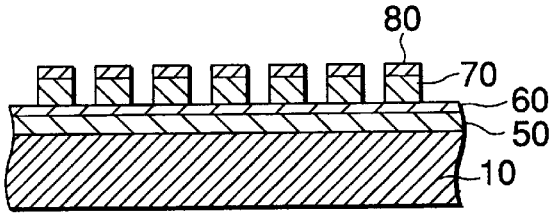
Figure 4F:
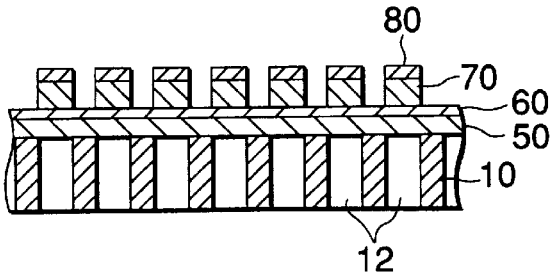

A reference number 20 is a sealing plate 0.1 to 1 mm thick in which the above ink supply communicating port 21 is formed and the sealing plate is composed of glass ceramics the coefficient of linear expansion of which is 2.5 to 4.5 [$\times10^{-6}$/° C.] at 300° C. or less. Glass ceramics are produced by baking a main component composed of glass and ceramics literally in the state of a green sheet formed in a desired shape at high temperature. The ink supply communicating port 21 may be also one slit or plural slits respectively crossing each communicating part 14 as shown in FIG. 3. One surface of the sealing plate 20 covers one surface of the silicon monocrystalline substrate 10 overall and functions as a reinforcing plate for keeping the silicon monocrystalline substrate 10 from impact or external force. In addition, the other surface of the sealing plate 20 constitutes a wall of the common ink chamber 31. A reference number 30 denotes a common ink chamber forming plate forming the peripheral wall of the common ink chamber 31 and the common ink chamber forming plate is produced by punching a stainless steel sheet with suitable thickness according to the number of nozzle apertures and an ink droplet jetting frequency.

In this embodiment, the thickness is set to 0.2 mm. A reference number 40 denotes an ink chamber side plate also composed of a stainless steel sheet, a thin wall 41 is formed in a part of the ink chamber side plate by half etching and an ink leading port 42 for receiving ink from outside is punched. In this embodiment, the ink chamber side plate 0.2 mm thick is used and the thin wall 41 0.02 mm thick is formed in a part in consideration of the rigidity of the ink leading port 42 when it and an outside ink supply means are connected, however, an ink chamber side plate 0.02 mm thick may be also used beforehand to omit the formation of the thin wall 41 by half etching. The thin wall 41 functions as an absorber of pressure generated when an ink droplet is jetted and applied to the reverse side to the nozzle aperture 11 and prevents unnecessary positive or negative pressure from being applied to another pressure generating chamber 12 via the common ink chamber 31.

Next, a process for forming a piezoelectric material film 70 and others on the silicon monocrystalline substrate 10 will be described. As shown in FIG. 4(*a*), first, an elastic film composed of silicon dioxide is formed by thermally oxidizing a wafer for the silicon monocrystalline substrate 10 in a diffusion furnace heated at approximately 1100° C.

Next, as shown in FIG. 4(*b*), a lower electrode film 60 is formed by sputtering. For the material of the lower electrode film 60, platinum (Pt) and others are suitable. The reason why platinum and others are suitable. is that the piezoelectric material film 70 formed by sputtering or a sol-gel method and described later is required to be baked at the temperature of approximately 600 to 1000° C. in the atmosphere or in an atmosphere of oxygen after the formation of the film and crystallized. Therefore, the material of the lower electrode film 60 is required to keep conductive in such an oxidized atmosphere heated at high temperature. Particularly if lead zirconate titanate (PZT) is used for the material of the piezoelectric material film 70, it is desirable that the change of conductivity by the diffusion of lead monoxide (PbO) is small and platinum is suitable for these reasons.

Next, as shown in FIG. 4(*c*), the piezoelectric material film 70 is formed. Sputtering may be also used for a method of forming the piezoelectric material film, however, in this embodiment, a so-called sol-gel method in which so-called sol in which a metallic organic substance is dissolved in a solvent gels by application and drying and the piezoelectric material film 70 composed of metallic oxide is obtained by baking it further at high temperature is used. For the material of the piezoelectric material film 70, it is suitable-to use lead zirconate titanate (PZT) for an ink jet head.

Next, as shown in FIG. 4(*d*), the upper electrode film 80 is formed. The upper electrode film 80 only has to be a very conductive material, so that many metals such as aluminum (Al), gold (Au), nickel (Ni) and platinum (Pt), conductive oxide and others can be used and in this embodiment, the upper electrode film is formed by sputtering platinum (Pt).

Next, as shown in FIG. 4(*e*), the upper electrode film 80 and the piezoelectric material film 70 are patterned so that each piezoelectric element is arranged corresponding to each pressure generating chamber 12. FIG. 4(*e*) shows a case that the piezoelectric material film 70 is patterned using the same pattern as the upper electrode film 80, however, the piezoelectric material film 70 is not necessarily required to be patterned. It is because if a voltage is applied to the upper electrode film 80 according to a pattern as an individual electrode, an electric field is applied only between each upper electrode film 80 and the lower electrode film 60 which is a common electrode and has no effect upon the other part.

Figure 5:
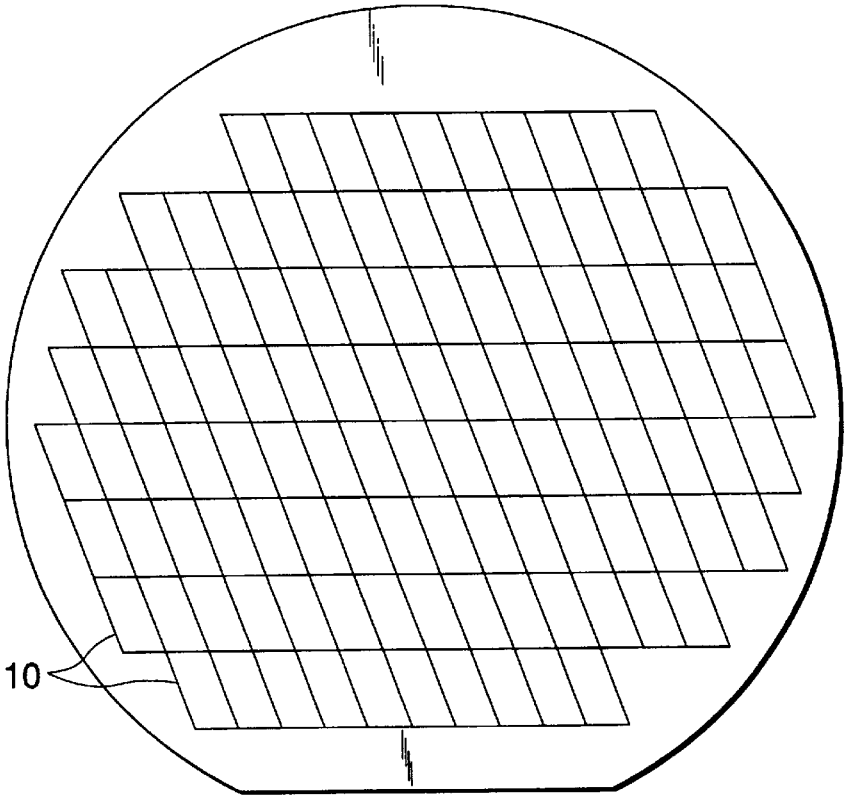
FIG. 5 shows the arrangement of silicon monocrystalline substrates on a wafer in the first embodiment of the present invention.

The process for forming the films is described above. After the films are formed as described above, the silicon monocrystalline substrate 10 is anisotropically etched by the above alkaline solution as shown in FIG. 4(*f*) and the pressure generating chamber 12 and others are formed. After multiple chips are simultaneously formed in one wafer as shown in FIG. 5 and a process for a series of the formation of the films and the anisotropic etching is finished, the wafer is divided into the size of the silicon monocrystalline substrate 10 shown in FIG. 1 and others.

Figure 6A:
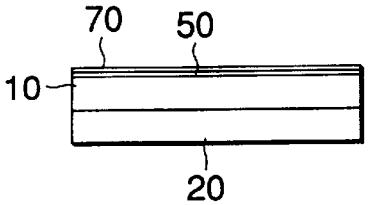
FIGS. 6(*a*)–(*c*) show behavior in a case not depending upon the present invention.
Figure 6B:
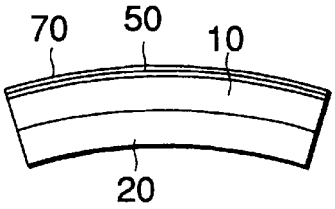
Figure 6C:
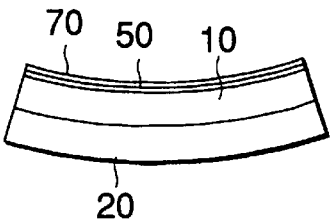

In the above described silicon monocrystalline substrate 10, when the process for the formation of the films and the anisotropic etching is finished, the sealing plate 20, the common ink chamber forming substrate 30 and the ink chamber side plate 40 are sequentially bonded and integrated. In an ink jet recording head formed as described above, even if the common ink chamber forming plate 30 and the ink chamber side plate 40 respectively composed of a stainless steel sheet with a large coefficient of linear expansion are expanded or contracted as printer working temperature changes, the thin films such as the elastic film 50 function without being influenced by the above expansion or contraction because of the rigidity of the sealing plate 20 the coefficient of linear expansion of which is approximately equal to that of the silicon monocrystalline substrate 10. FIGS. 6(*a*), 6(*b*) and 6(*c*) show an effect upon the thin films when a stainless steel sheet with a large coefficient of linear expansion is used for the sealing plate 20. FIG. 6(*a*) shows a state in which the thin films bonded and hardened at the room temperature of 20° C. are left under room temperature to reduce the effect of expansion or contraction due to difference in temperature. Naturally, as there is no difference in temperature, the bonded films are planar and no external stress is applied to the thin films.

FIG. 6(*b*) shows a state in which the bonded films shown in FIG. 6(*a*) are left in the low temperature operating environment of 5° C. of a printer. As the thermic contraction of the sealing plate 20 and others is larger than that of the silicon monocrystalline substrate 10, the thin films are warped so as to be pulled. Particularly, the apparent Young's modulus of the elastic film 50 is increased and a vibrational cycle is shortened. FIG. 6(*c*) shows a state in which the bonded films shown in FIG. 6(*a*) are left in the high temperature operating environment of 35° C. of a printer. As the coefficient of thermal expansion of the sealing plate 20 and others is larger than that of the silicon monocrystalline substrate 10, the thin films are warped so as to be loose. Particularly, the apparent Young's modulus of the elastic film 50 is decreased and a vibrational cycle is extended. The difference among the states shown in FIG. 6(*a*) to FIG. 6(*c*)

is an important problem in the ink jet recording head for jetting an ink droplet by the displacement smaller than 1 $\mu$m of a piezoelectric element. In this embodiment, the effect of change in temperature is solved by the sealing plate 20. Although it is ideal that the coefficient of linear expansion of the sealing plate 20 is $3\times[10^{-6}/°$ C.] which is equal to that of the silicon monocrystalline substrate 10, the coefficient of linear expansion of the sealing plate is an allowable range in an ink droplet jetting characteristic according to experiments by the inventors if the value is up to approximately $[6\times10^{-6}/°$ C.] which is twice the coefficient of linear expansion of the silicon monocrystalline substrate 10. An epoxy adhesive is used for bonding, however, as the difference in the quantity of expansion or contraction caused by the difference in temperature is not required to be considered, a new effect is proven wherein the films are bonded and hardened for a short time under the high temperature of 80° C. and the time of a bonding process is also reduced.

Finally, a connecting cable 100 for sending a driving signal from an external circuit not shown to a piezoelectric element is connected via an anisotropic conductive film 90 thermically welded and the ink jet recording head is completed.

The ink jet recording head constituted as described above receives ink from the ink leading port 42 connected to external ink supply means not shown and fills the inside from the common ink chamber 31 to the nozzle aperture 11 with ink. The ink jet recording head applies a voltage between the lower electrode film 60 and the upper electrode film 80 via the connecting cable 100 according to a recording signal from an external driving circuit not shown, increases pressure in the pressure generating chamber 12 by bending and deforming the elastic film 50 and the piezoelectric material film 70 and records by jetting an ink droplet from the nozzle aperture 11.

Second Embodiment

Figure 7:
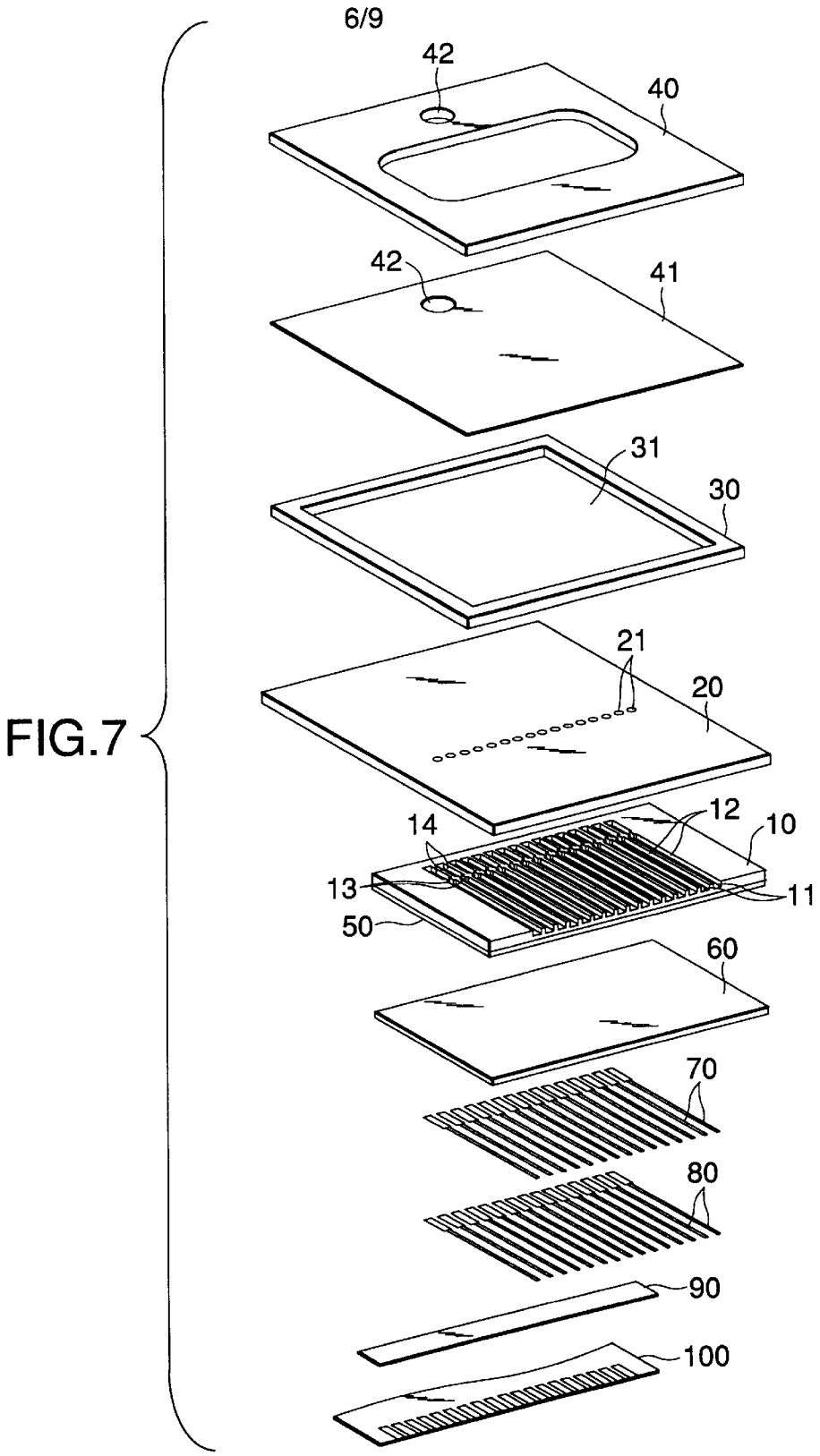
FIG. 7 is an exploded perspective drawing showing a second embodiment of the present invention.

FIG. 7 is an exploded perspective drawing showing a second embodiment of the ink jet recording head according to the present invention. A sealing plate 20, a common ink chamber forming plate 30, an ink chamber side plate 40 and a thin wall 41 are constituted by glass ceramics the coefficient of linear expansion of which is 2.5 to 4.5 $[\times10^{-6}/°$ C.]. Hereby, parts constituting the head are all parts the coefficient of linear expansion of which is close to that of a silicon monocrystalline substrate 10 and are free from the effect of a difference in the quantity of expansion or contraction between the parts as temperature changes.

Figures 8A, 8B, 8C, 8D:
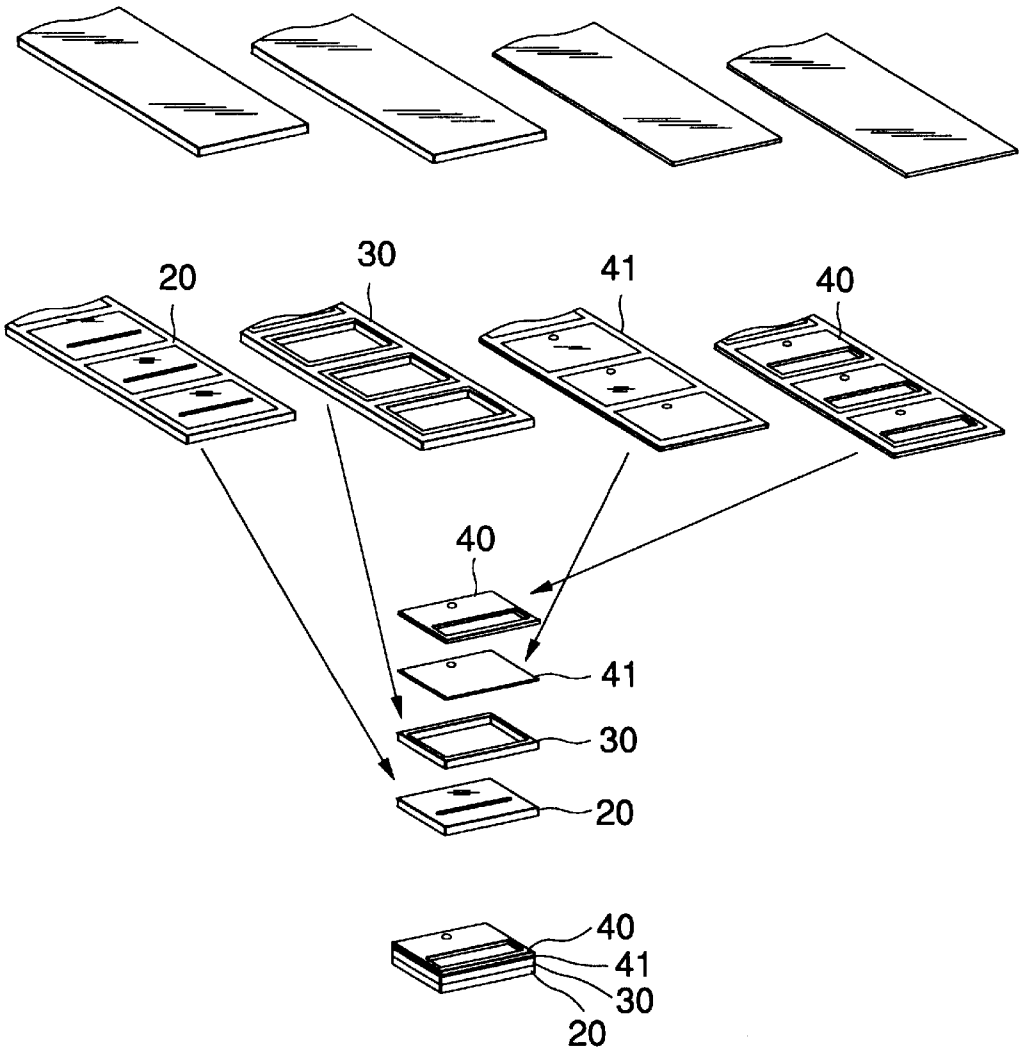
FIGS. 8(*a*)–(*d*) show a manufacturing process in the second embodiment of the present invention.

FIGS. 8(*a*)–8(*d*) show the manufacturing process of glass ceramic parts constituting a common ink chamber 31. First, a sheet equivalent to the thickness of each part is produced as shown in FIG. 8(*a*). Next, the shape of each part is formed by a press as shown in FIG. 8(*b*). At this time, each part is formed in the thickness and dimension expecting the contraction in baking. Next, each part is laminated as shown in FIG. 8(*c*). Finally, the laminated parts are baked and integrated as shown in FIG. 8(*d*). Hereby, a part integrated without using an adhesive and forming the common ink chamber 31 is completed. As the integrated glass ceramic part forming the common ink chamber 31 and the silicon monocrystalline substrate 10 on which the films are formed have only to be bonded, the manufacturing process can be greatly simplified.

The silicon monocrystalline substrate 10 obtains a firm reinforcing plate of the integrated glass ceramics and is provided with sufficient strength as a head. As the remaining constitution of the head except for the parts constituting the common ink chamber 31 is the same as in the first embodiment shown in FIGS. 1 to 4, the description is omitted.

Third Embodiment

In a third embodiment of the ink jet recording head according to the present invention, an alloy of iron and nickel (generally called invar) the coefficient of linear expansion of which is 2.5 to $4.5\times[10^{-6}/°$ C.] is used for the material of the sealing plate 20 in the first embodiment. The alloy of iron and nickel is produced by press working and electroless nickel plating is applied to the whole surface by 2 to 5 $\mu$m to secure resistance to ink. As the shape of a sealing plate 20 and the other constitution of the head are the same as in the first embodiment, the description is omitted.

Fourth Embodiment

In a fourth embodiment of the ink jet recording head according to the present invention, for the material of the sealing plate 20, the common ink chamber forming plate 30 and the ink chamber side plate 40 respectively in the second embodiment, an alloy of iron and nickel the coefficient of linear expansion of which is 2.5 to $4.5\times[10^{-6}/°$ C.] is used. The alloy of iron and nickel is produced by press working and electroless nickel plating is applied to the whole surface to secure resistance to ink. Each part is bonded and laminated as in the first embodiment.

As the remaining constitution of the head except for the parts constituting a common ink chamber 31 is the same as in the first embodiment shown in FIGS. 1 to 4 and the effect is the same as in the second embodiment, the description is omitted.

Fifth Embodiment

Figure 9:
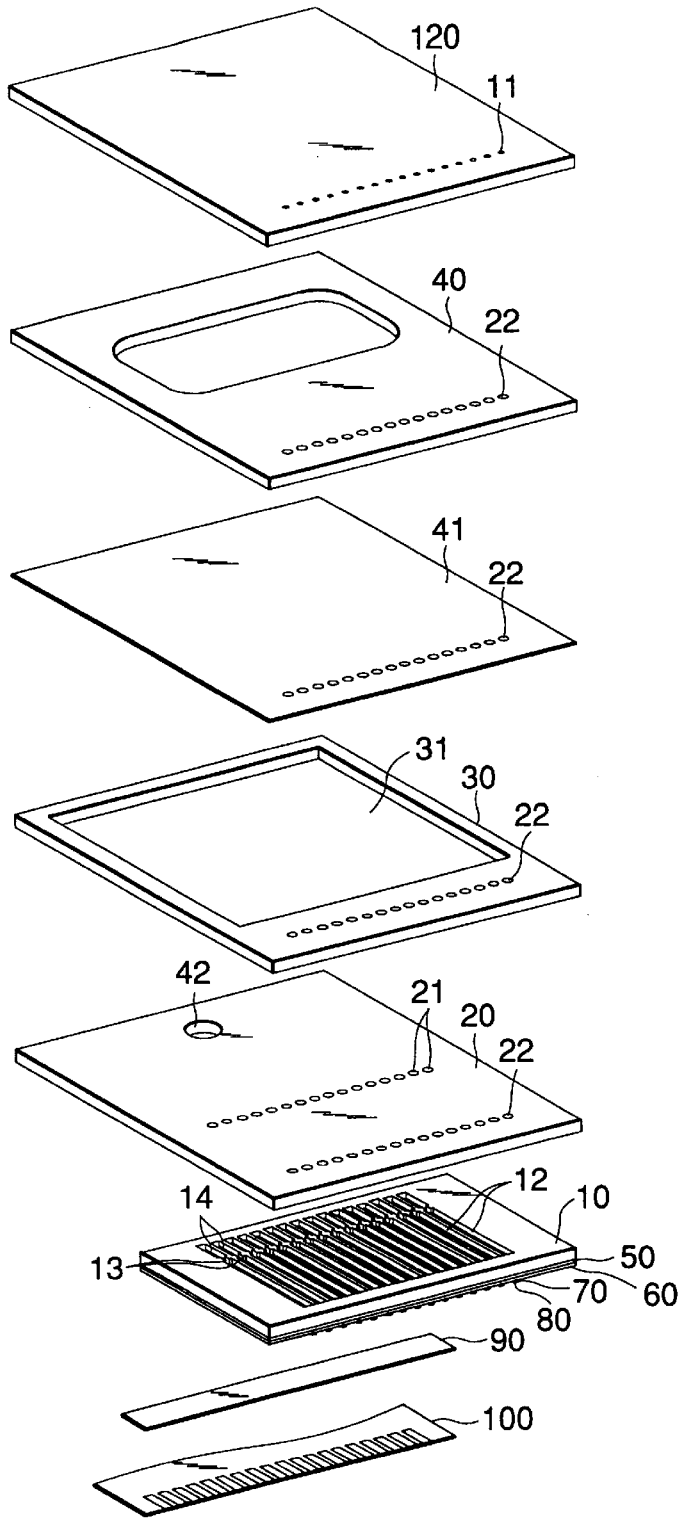
FIG. 9 is an exploded perspective drawing showing a fifth embodiment of the present invention.
Figure 10:
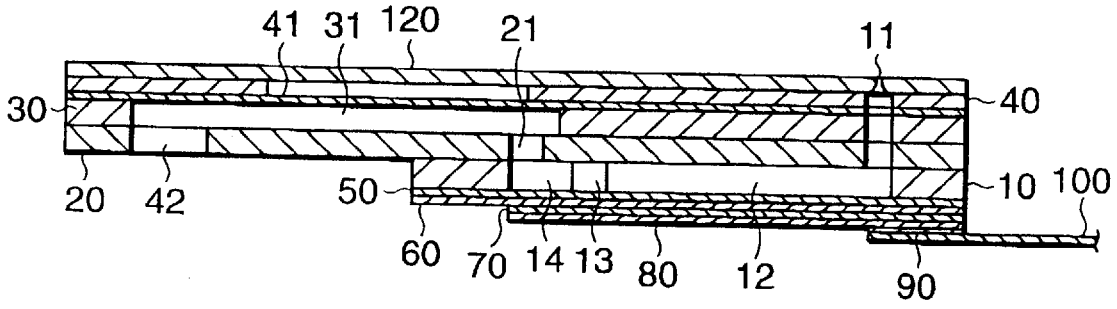
FIG. 10 is a sectional view showing an ink passage in the fifth embodiment of the present invention.

FIG. 9 is an exploded perspective drawing showing a fifth embodiment of the ink jet recording head according to the present invention and FIG. 10 shows the section of an ink passage shown in FIG. 9. In a fifth embodiment, nozzle apertures 11 are arranged on a plane reverse to piezoelectric elements to facilitate capping and reduce the depth in the rear of the nozzle aperture 11. As shown in FIGS. 9 and 10, a reference number 120 denotes a nozzle substrate in which nozzle apertures 11 are formed. A reference number 22 denotes a nozzle communicating port connecting each nozzle aperture 11 and the corresponding pressure generating chamber 12 and the nozzle communicating port pierces a sealing plate 20, a common ink chamber forming plate 30, a thin wall 41 and an ink chamber side plate 40. As the constitution of a silicon monocrystalline substrate 10, an elastic film 50, a lower electrode film 60, a piezoelectric material film 70 and an upper electrode film 80 except the nozzle aperture 11 is the same as in the first embodiment, the description is omitted.

The material constituting the common ink chamber 31 may be any material constituting the common ink chamber in the first to fourth embodiments of the present invention, however, in the fifth embodiment, the nozzle substrate 120, the ink chamber side plate 40, the thin wall 41, the common ink forming plate 30 and the sealing plate 20 are all constituted by glass ceramics the coefficient of linear expansion of which is 2.5 to $4.5\times[10^{-6}/°$ C.]. The manufacturing method is the same as in the second embodiment and the effect is the same as in the above embodiments. The nozzle communicating port 22 also may be formed individually in four parts of the sealing plate 20, the common ink chamber forming plate 30, the thin wall 41 and the ink chamber side plate 40, however, in this embodiment, after the above four parts are laminated, the port is collectively formed by a press. Hereby, as the misregistration of the nozzle communicating port piercing the four parts is solved and no part is formed with a difference in the level in (which bubbles which are not desirable for the ink jet recording head) are easily stagnated, the reliability of the head can be secured.

An ink leading port 42 for supplying ink from the outside not shown is provided in the sealing plate 20. As the ink leading port 42 is provided on the side of the sealing plate 20, a connecting cable 100 is led out in a direction reverse to that in the first embodiment.

As described above, according to the ink jet recording head according to the present invention, the number of silicon monocrystalline substrates manufactured in one wafer is increased and the unit price of the head can be reduced by providing a common ink chamber outside a silicon monocrystalline substrate in a high density head constituted by a film forming process and anisotropically etching the silicon monocrystalline substrate. A fragile silicon monocrystalline substrate is reinforced by using material the coefficient of linear expansion of which is close to that of the silicon monocrystalline substrate at least for a sealing plate and an effect upon a thin film piezoelectric element caused by a difference in the quantity of expansion or contraction between materials in the change of temperature is prevented. As a result, a high density and very reliable head can be supplied at a low price.

What is claimed is:

1. An ink jet recording head comprising:

a substrate;

a plurality of pressure generating chambers formed in said substrate, said pressure generating chambers being respectively communicated with nozzle apertures;

an elastic film formed on one surface of said substrate;

a piezoelectric element defined by laminating a piezoelectric material film and an electrode film on a surface of said elastic film corresponding to each pressure generating chamber, each pressure generating chamber being associated with a narrow part and a communicating part formed spaced apart from a corresponding one of said nozzle apertures in said substrate; and a sealing plate sealing the other surface of said substrate, said sealing plate being provided with an ink supply communicating port connecting said communicating part and a common ink chamber.

2. The ink jet recording head according to claim 1, wherein said substrate comprises a silicon monocrystalline substrate, and further wherein at least said sealing plate is formed by a material having a coefficient of linear expansion which does not exceed two times that of said silicon monocrystalline substrate.

3. The ink jet recording head according to claim 1, wherein at least said sealing plate is formed by glass ceramics having a coefficient of linear expansion of 2.5 to 4.5 $\{\times 10^{-6}/°\ C.\}$.

4. The ink jet recording head according to claim 1, wherein said common ink chamber is formed in a common ink chamber forming plate, said forming plate and said sealing plate being formed by glass ceramics having a coefficient of linear expansion of 2.5 to 4.5 $\{\times 10^{-6}/°\ C.\}$, and further wherein said common ink chamber forming plate and said sealing plate are integrated by one of molding and baking after lamination and by laminating and baking after molding.

5. The ink jet recording head according to claim 1, wherein at least said sealing plate is formed by an alloy of iron and nickel having a coefficient of linear expansion of 2.5 to 4.5 $\{\times 10^{-6}/°\ C.\}$.

6. The ink jet recording head according to any one of claims 1 to 5, wherein said common ink chamber is provided with a thin wall at least in part of a surface opposite to said sealing plate.

7. The ink jet recording head according to claim 1, wherein said common ink chamber is defined by said sealing plate, a common ink chamber forming plate and an ink chamber side plate.

8. The ink jet recording head according to claim 7, wherein a thin wall is provided with said ink chamber side plate.

9. The ink jet recording head according to claim 7, wherein said ink chamber side plate is formed by two piece members.

10. The ink jet recording head according to claim 1, further comprising:

a nozzle plate including said nozzle apertures; and a hole communicated with each of said nozzle apertures, each said hole passing through at least said sealing plate and said common ink chamber forming plate.

11. The ink jet recording head according to claim 1, wherein one surface of said common ink chamber is said sealing plate.

12. The ink jet recording head according to claim 1, wherein said substrate comprises a silicon monocrystalline substrate.

13. The ink jet recording head according to claim 1, wherein at least said sealing plate comprises glass ceramics.

14. The ink jet recording head according to claim 13, wherein said glass ceramics has a coefficient of linear expansion within 2.5 to 4.5 $\{\times 10^{-6}/°\ C.\}$, and said glass ceramics is used at least for the sealing plate of members forming said common ink chamber.

15. The ink jet recording head according to claim 1, wherein said sealing plate is formed by glass ceramics.

16. The ink jet recording head according to claim 15, wherein said glass ceramics has a coefficient of linear expansion within 2.5 to 4.5 $\{\times 10^{-6}/°\ C.\}$.

17. The ink jet recording head according to claim 16, wherein said common ink chamber is formed in a common ink chamber forming plate, and further wherein said common ink chamber forming plate and said sealing plate are integrated by one of molding and baking after lamination and by laminating and baking after molding.

18. The ink jet recording head according to claim 1, wherein at least said sealing plate is formed by an alloy of iron and nickel.

19. The ink jet recording head according to claim 18, wherein said alloy of iron and nickel has a coefficient of linear expansion within 2.5 to 4.5 $\{\times 10^{-6}/°\ C.\}$.

* * * * *